US006164653A

United States Patent [19]

Chuang

[11] Patent Number: 6,164,653

[45] Date of Patent: Dec. 26, 2000

[54] FISHING TOY STRUCTURE

[76] Inventor: Chuan-Tien Chuang, No. 40, Lane 174, Da-Shing St., Tainan, Taiwan

[21] Appl. No.: 09/310,179

[22] Filed: May 12, 1999

[51] Int. Cl.[7] ..... A63F 9/30; A63H 11/00; A63H 13/20

[52] U.S. Cl. ..... 273/447; 446/72; 446/239; 446/310; 446/332; 273/140; 273/109

[58] Field of Search ..... 446/236, 237, 446/238, 239, 72, 308, 310; 273/280, 281, 447, 110, 115, 448, 109, 140

[56] References Cited

U.S. PATENT DOCUMENTS

| | | | |
|---|---|---|---|
| 4,224,761 | 9/1980 | Wakimura | 273/330 |
| 4,603,860 | 8/1986 | Wey | 273/140 |
| 4,790,532 | 12/1988 | Chen | 273/1 |
| 4,838,553 | 6/1989 | Chuang | 273/1 |
| 4,861,026 | 8/1989 | Chuang | 273/1 |
| 4,936,574 | 6/1990 | Lee | 273/1 |
| 5,009,418 | 4/1991 | Chuang | 273/448 |
| 5,163,863 | 11/1992 | Goldfarb et al. | 446/236 |
| 5,193,819 | 3/1993 | Chen | 273/448 |
| 5,609,341 | 3/1997 | Chuang | 273/448 |

*Primary Examiner*—Kien T. Nguyen
*Assistant Examiner*—Kevin Hughes
*Attorney, Agent, or Firm*—Dougherty & Troxell

[57] ABSTRACT

A fishing toy includes a rotary disk and a plurality of toy fishes. The rotary disk has a circular rack, engaging gears installed within the toy fishes. Blocks are installed on the gear. By rotating, the blocks will drive the toy fishes to simulate the action of real fishes. Moreover, the heads of the toy fishes may move upwards and downwards opening and closing the fish mouth. Thus, player may hook a toy fish with a fishing rod.

4 Claims, 13 Drawing Sheets

FISHING TOY STRUCTURE

FIELD OF THE INVENTION

The present invention relates to a fishing toy structure, wherein a toy fish body is arranged on a horizontal rotary disk such that, with the rotation of the rotary disk, the head of the toy fish may move upwards, the mouth of the toy fish may open and the fish tail may swing. The present invention is used to simulate various fishing actions or the like.

BACKGROUND OF THE INVENTION

As shown in FIGS. 1 and 2, a general fish toy is shown. A disk is installed in a track which has a wave-like shape. A plurality of round holes are formed on the disk. A toy fish body is shown in FIG. 3. A fish head is pivotally installed on the toy fish body, and then the structure is further installed in the hole of the disk. As the disk rotates, the toy fish bodies will rotate. When the toy fish body rotates to a higher track, it protrudes from the hole of the disk, and the fish head will move backwards to open it's mouth. Then the toy fish body travels through a lower track, it will descend into the hole and the mouth thereof will close. In the whole structure, the toy fish body only moves upwards and downwards vertically within the hole. The amusement effect is limited.

SUMMARY OF THE INVENTION

Accordingly, the primary object of the present invention is to provide a fishing toy, wherein the toy fish body is horizontally arranged on a rotary disk and rotates with the rotary disk. The head of the toy fish may move upwards and the mouth further opens, thus the bait can be inserted into the mouth.

Another object of the present invention is to provide a fishing toy in which the tail of the toy fish may swing upwards, downwards, leftwards, and rightwards.

In order to achieve the aforementioned object, the present invention provides a fishing toy comprising a rotary disk and a plurality of toy fish bodies. The rotary disk has a track disk and a loading disk with the loading disk installed on the track disk. The track disk has a plurality of circular racks, and the loading disk has a plurality of receiving spaces. Each receiving space has a hole and a pivot member. The hole protrudes through the rack, and the pivot member may move upwards or downwards. The outer side of the toy fish body includes a fish jaw. A gear is installed within the toy fish body, the gear having a block. The toy fish body is horizontally arranged above the pivot member of the loading disk. The gear is engaged with the rack of the track disk.

The track disk will rotate with respect to the loading disk. The fishing body will also move with the loading disk. In predetermined positions, the pivot member will move upwards to move the toy fish body upwards. Thus, the toy fish head will also move upwards. At this time, the fish jaw will move downwards, to open the mouth. When the toy fish body leaves this position, the pivot member will drop down, to restore the toy fish body to a horizontal position. The fish jaw also will move upwards to close the mouth. Thereby, the player may play a fishing game using a fishing road and bait.

The various objects and advantages of the present invention will be more readily understood from the following detailed description when read in conjunction with the appended drawing.

DETAILED DESCRIPTION OF THE PREFERRED EMBODIMENT

Figure 1:
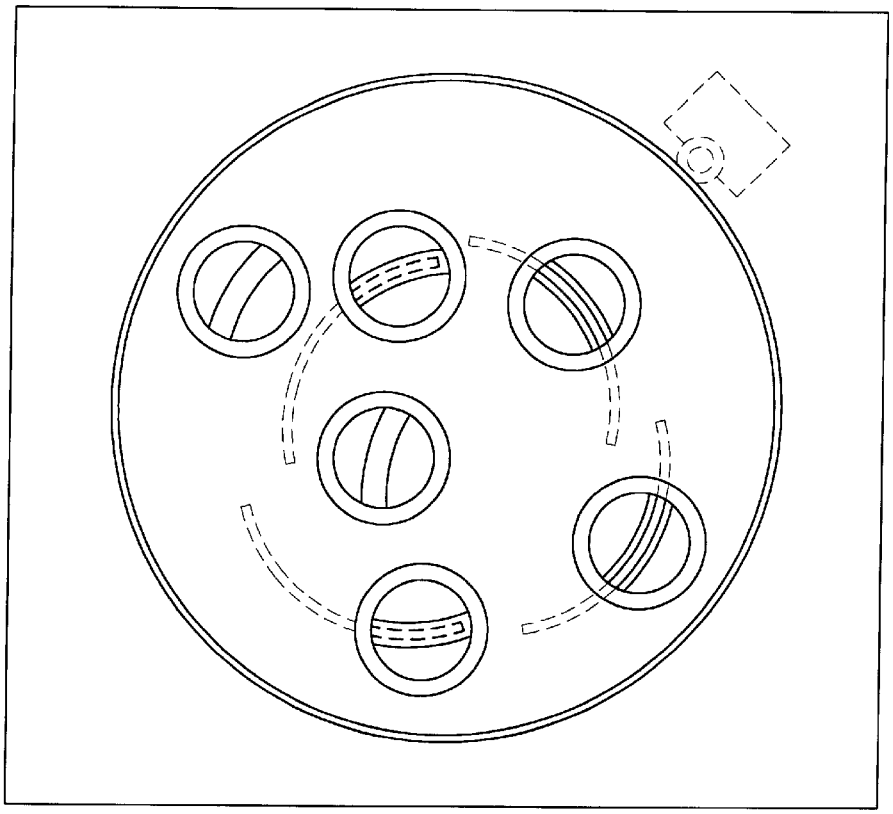
FIG. 1 PRIOR ART
FIG. 1 is perspective view of a prior art structure.
Figure 2:
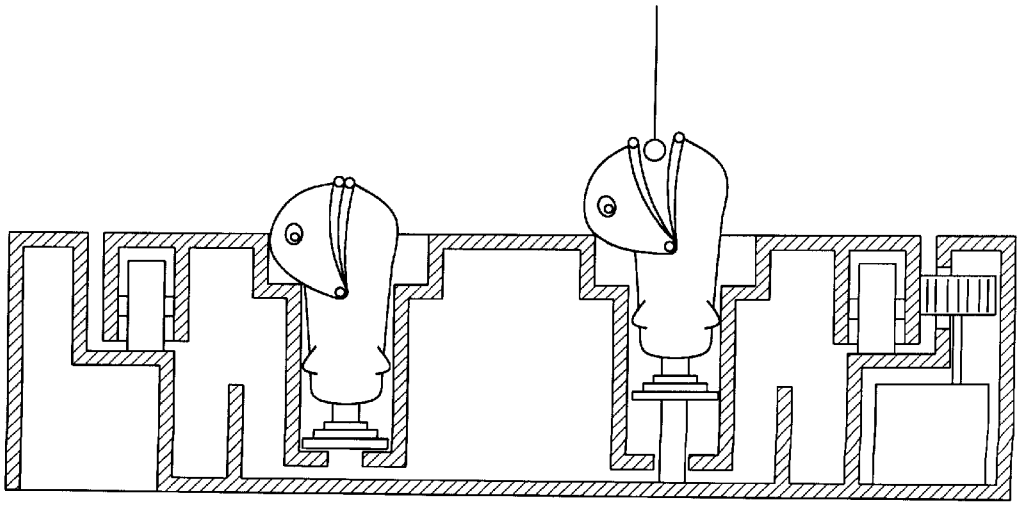
FIG. 2 PRIOR ART
FIG. 2 is a longitudinal cross sectional view of the prior art of FIG. 1.
Figure 3:
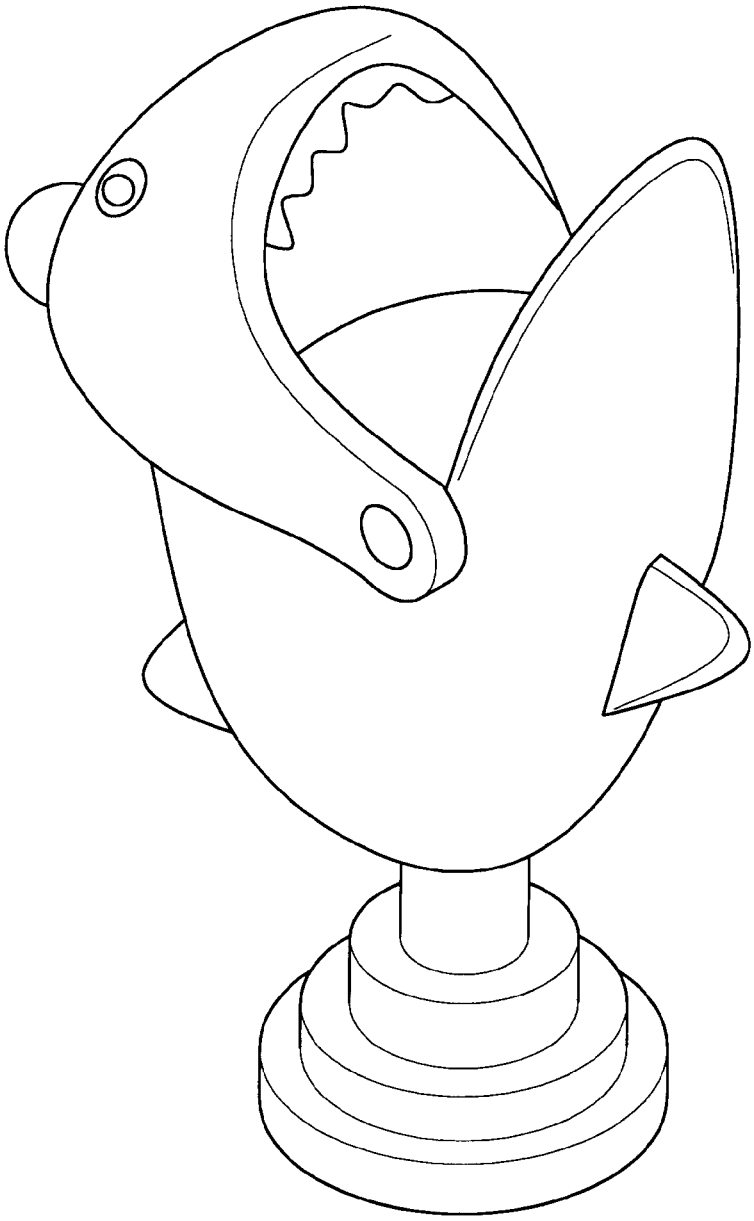
FIG. 3 PRIOR ART
FIG. 3 is a perspective view of a prior art toy fish body.
Figure 4:
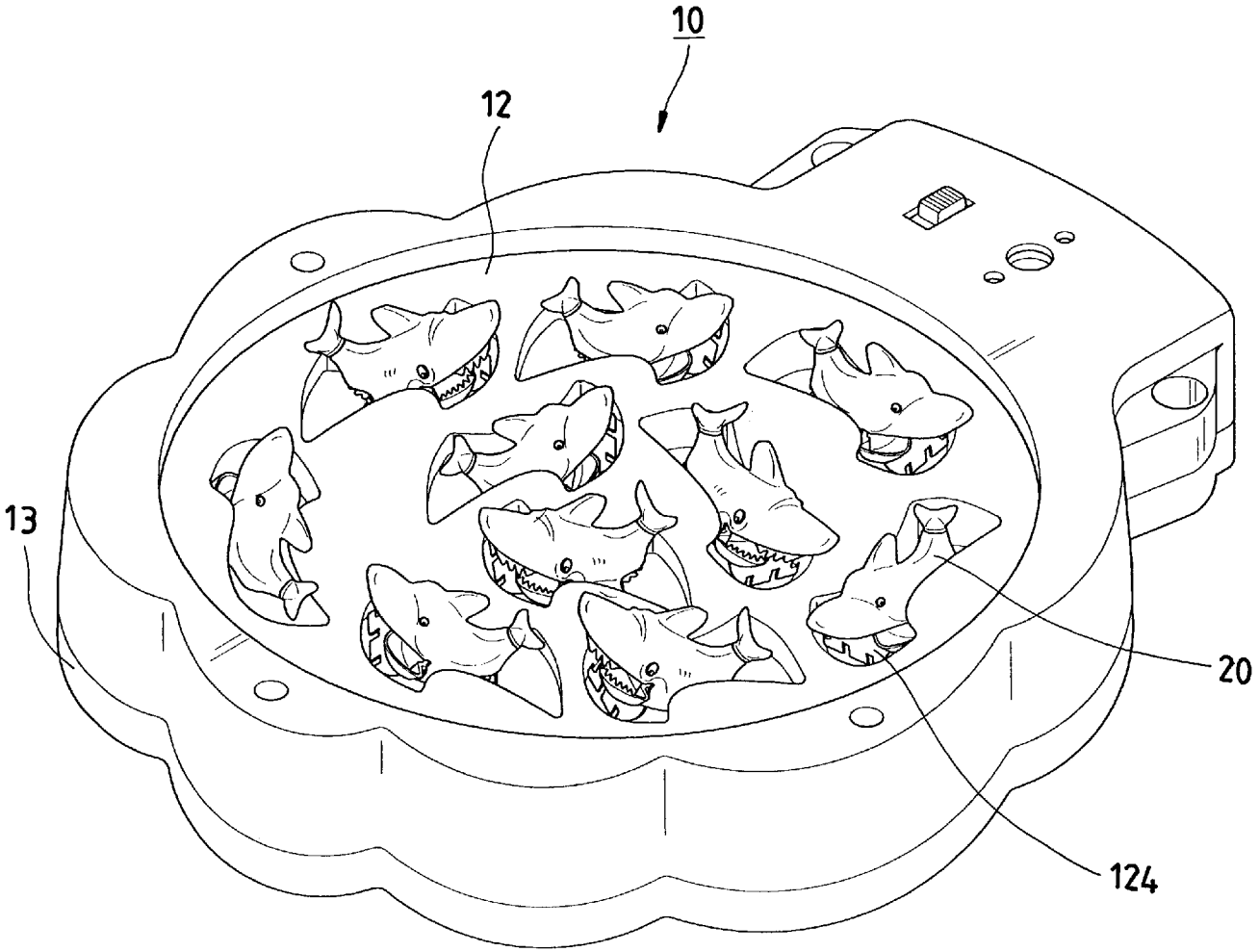
FIG. 4 is a perspective view of the fishing toy according to the present invention.

With reference to FIGS. 4, 5, 10, 11 and 14, the fishing toy according to the present invention is illustrated. The fishing toy of the present invention comprises a rotary disk 10 and a plurality of toy fishes 20. The rotary disk 10 includes a seat 13, a track disk 11 and a loading disk 12. The track disk 11 is installed on the seat 13. The loading disk 12 is installed on the track disk 11. The track disk 11 has a circular rack 113 on the lower rim thereof. A plurality of circular racks 111 are located on an upper portion of track disk 11. A cam plate 112 is installed aside the racks 111. A circular rack 121 is formed on the lower rim of the loading disk 12. The loading disk 12 is formed with a plurality of recessed receiving spaces 122. Each receiving space 122 has a long hole 123 and a pivot member 124. The long hole 123 has an approximately round shape. Each pivot member has a short post 125 which passes downwards through the loading disk 12. Cam plates 131 are installed on the seat 13 aside the racks 111. Each pivot member 124 has the short post 125 located approximately above one of the cam plates 112 and 131.

Figure 6:
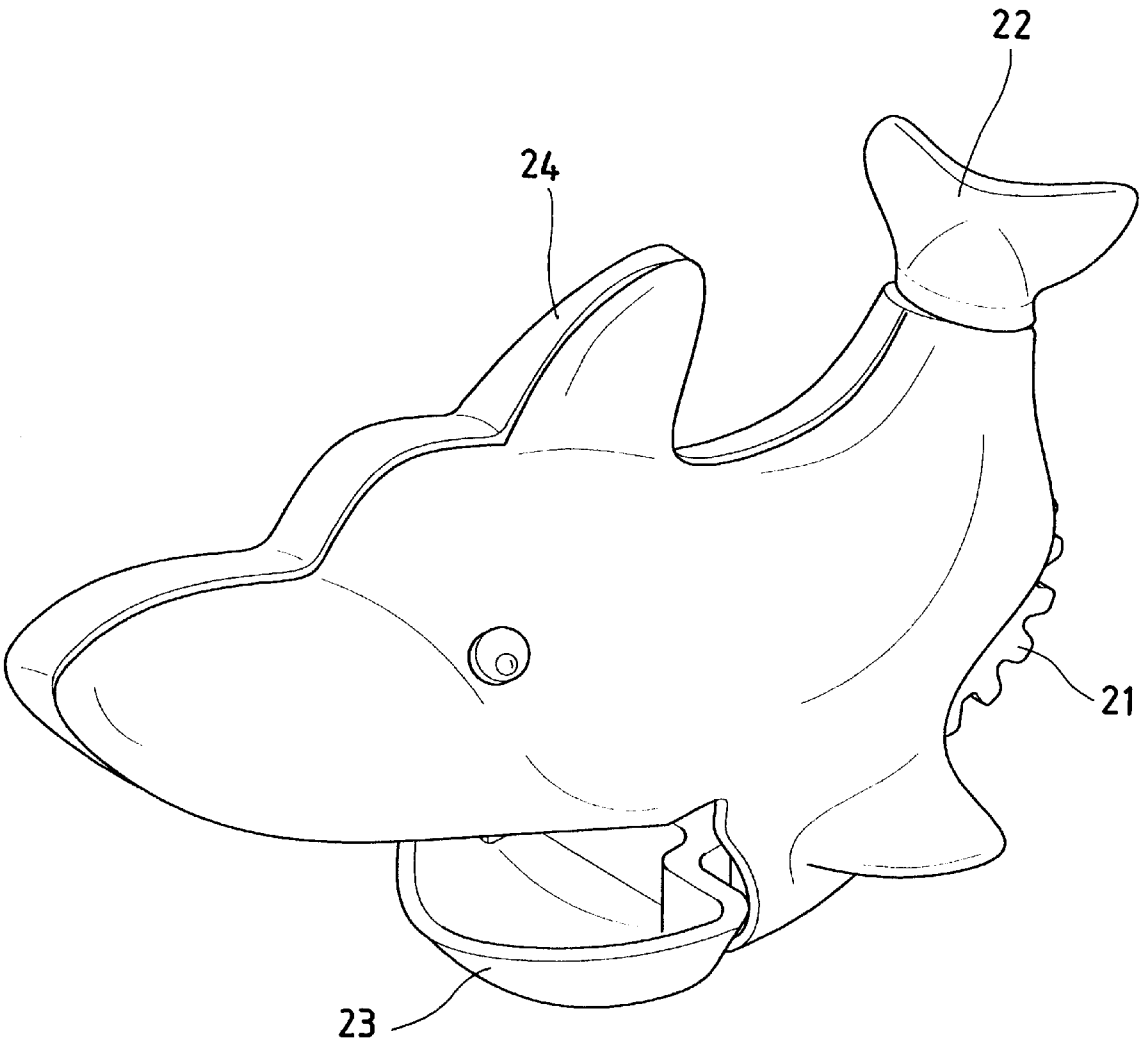
FIG. 6 is a perspective view showing the toy fish body of the present invention.
Figure 7:
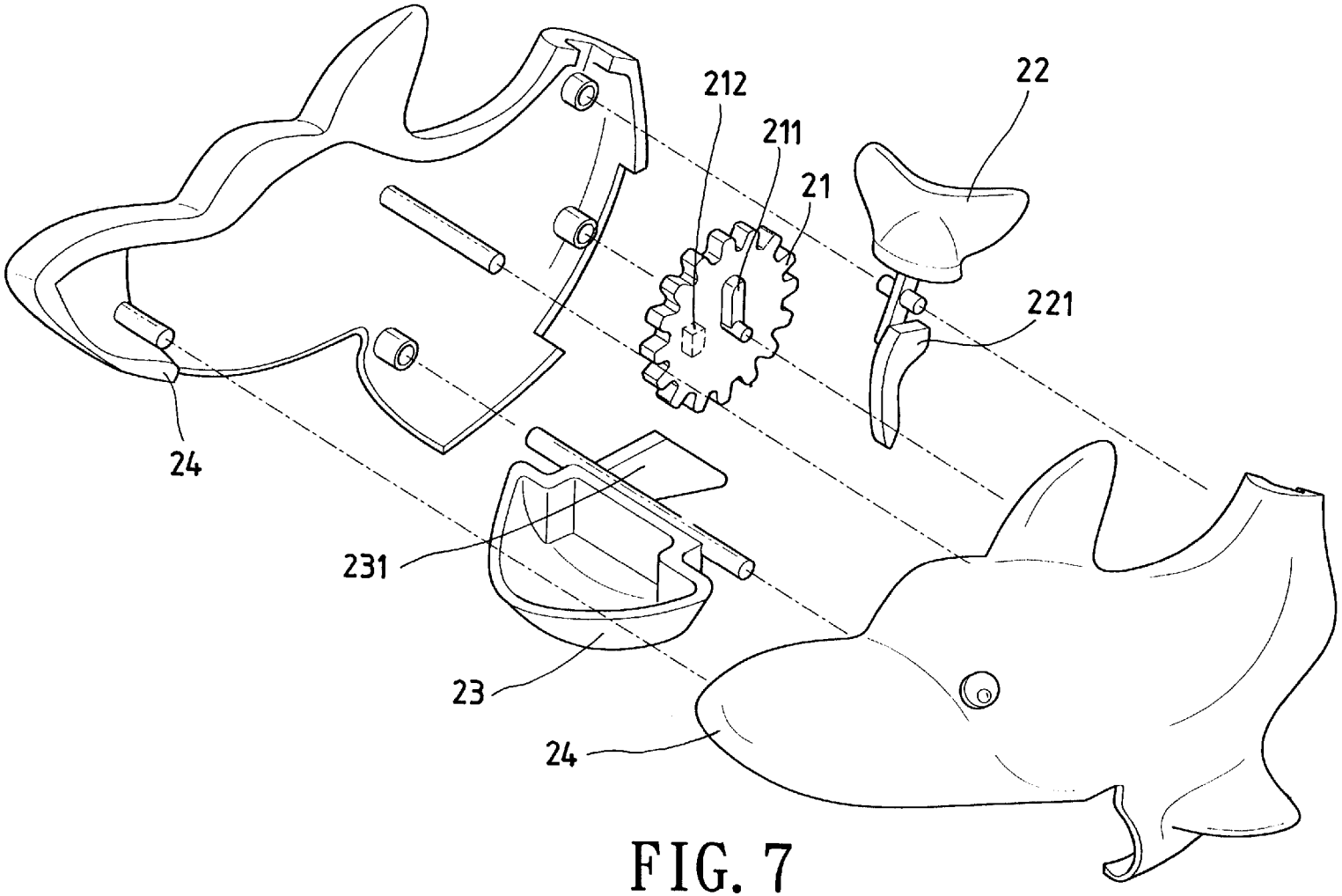
FIG. 7 is the exploded view of the components in FIG. 6.

With reference to FIGS. 6 and 7, each toy fish 20 is formed by a toy fish body 24, a fish jaw 23, and a fish tail 22. A gear 21 is installed therewithin. The gear 21 has blocks 211 and 212 on the two sides thereof. The fish jaw 23 and the fish tail 22 have a fish jaw block 231 and a fish tail block 221, respectively. The toy fish 20 is horizontally arranged in the receiving space 122 of the loading disk 12 such that the gear 21 engages the rack 111. Thus, the tail of the toy fish 20 may swing upwards and downwards.

Figure 8:
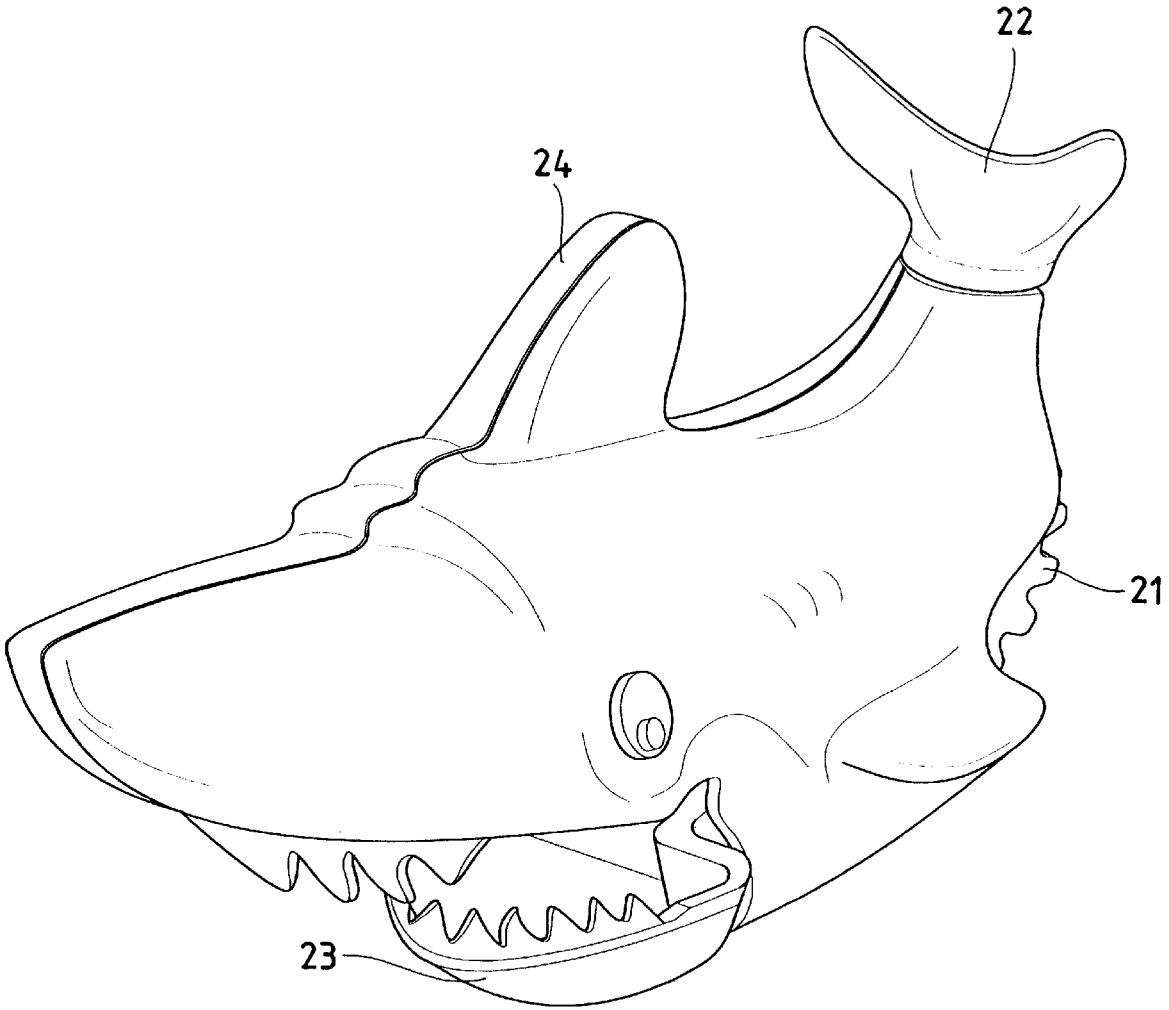
FIG. 8 is another perspective view of another toy fish body according to the present invention.
Figure 9:
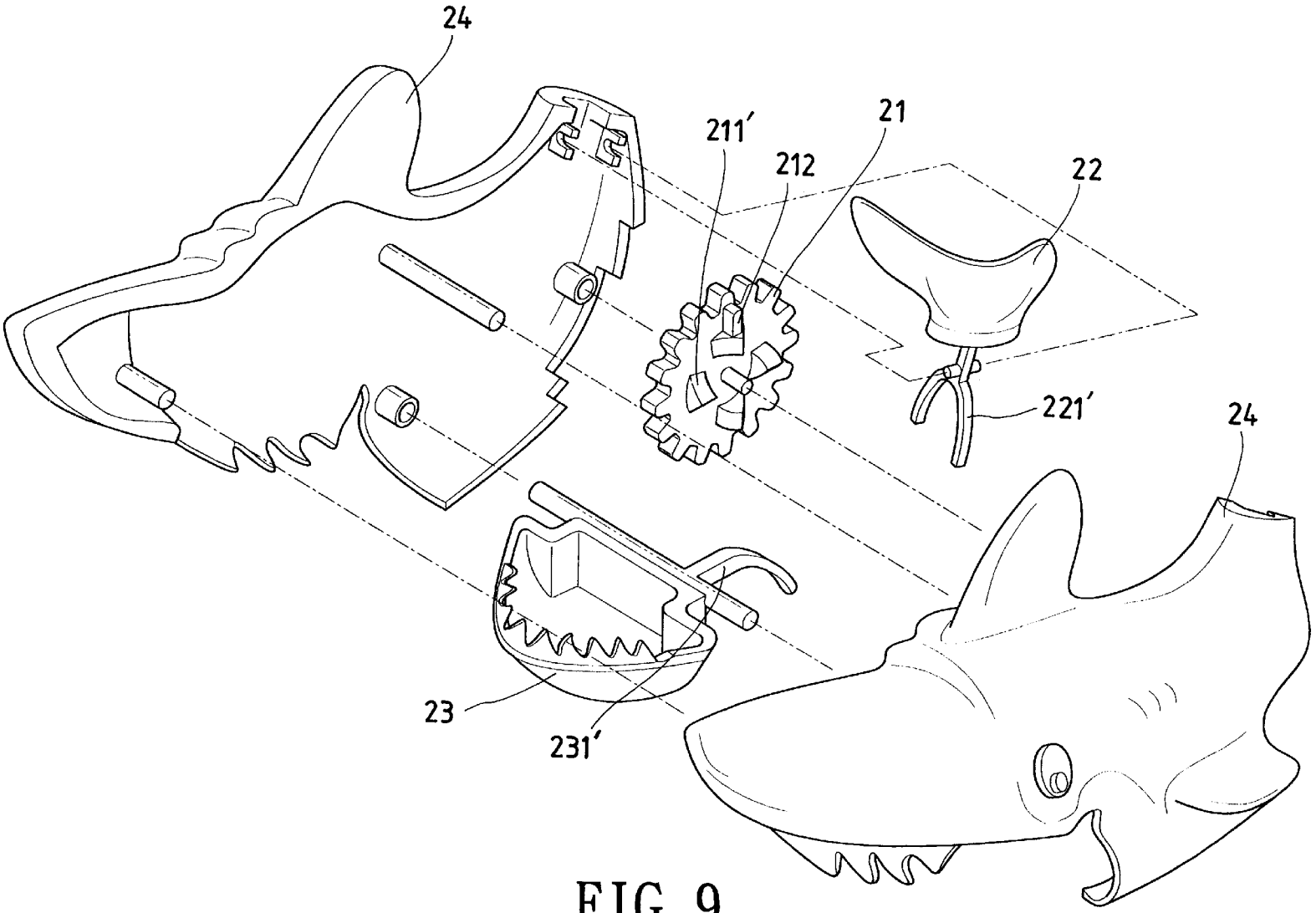
FIG. 9 is an exploded view of the components in FIG. 8.

Besides, referring to FIGS. 8 and 9, the toy fish according to the present invention may have various fish tail structures. A plurality of blocks 211' arranged in a crown shape are installed on the gear 21. A fish tail block 221' with an inverse Y shape is installed on the fish tail 22 and a slightly cambered fish jaw block 231' is installed on the fish jaw 23. Therefore, the fish tail of the fishing body may swing leftwards and rightwards.

Figure 5:
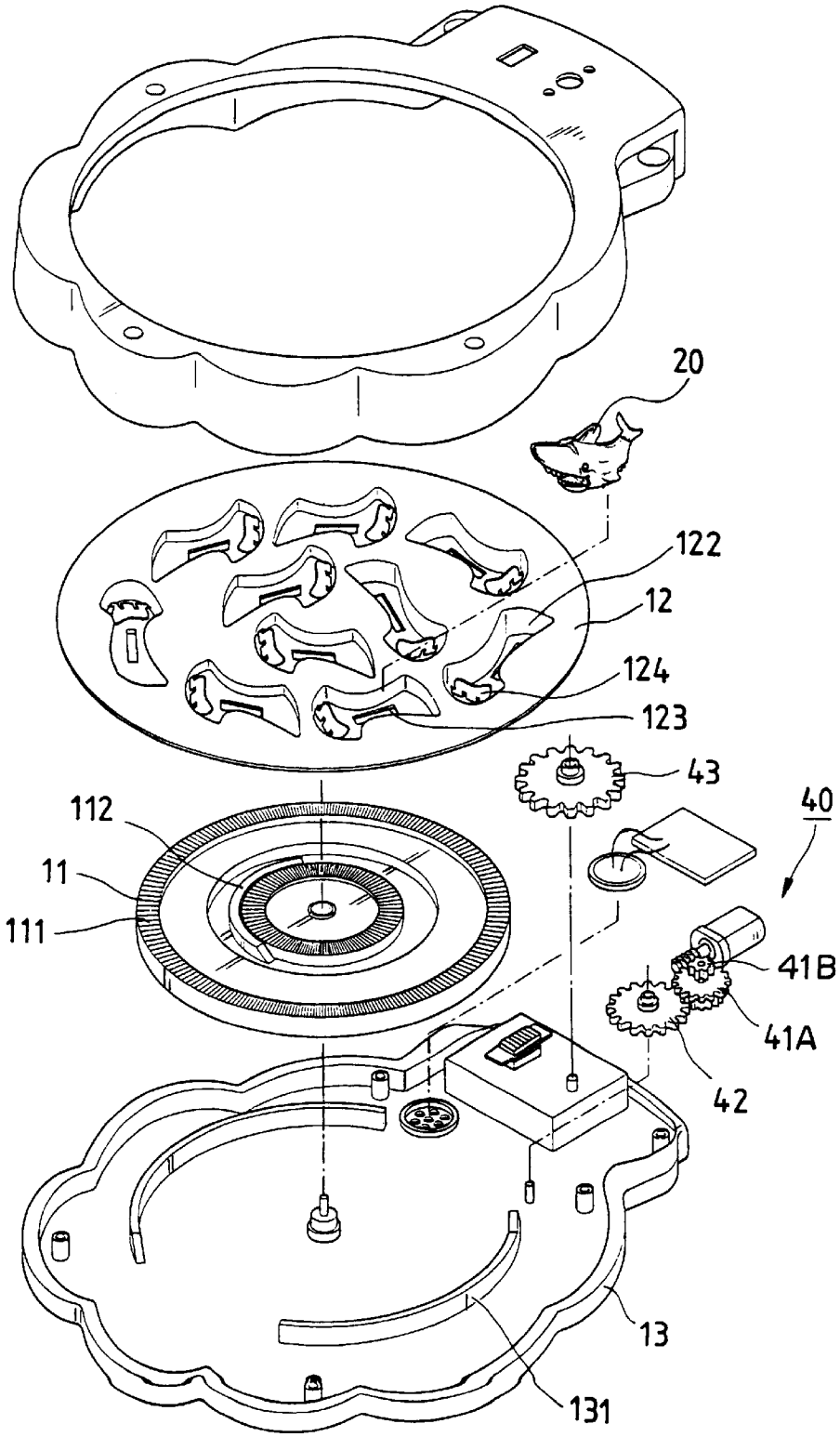
FIG. 5 is an exploded view showing the components of the present invention.
Figure 10:
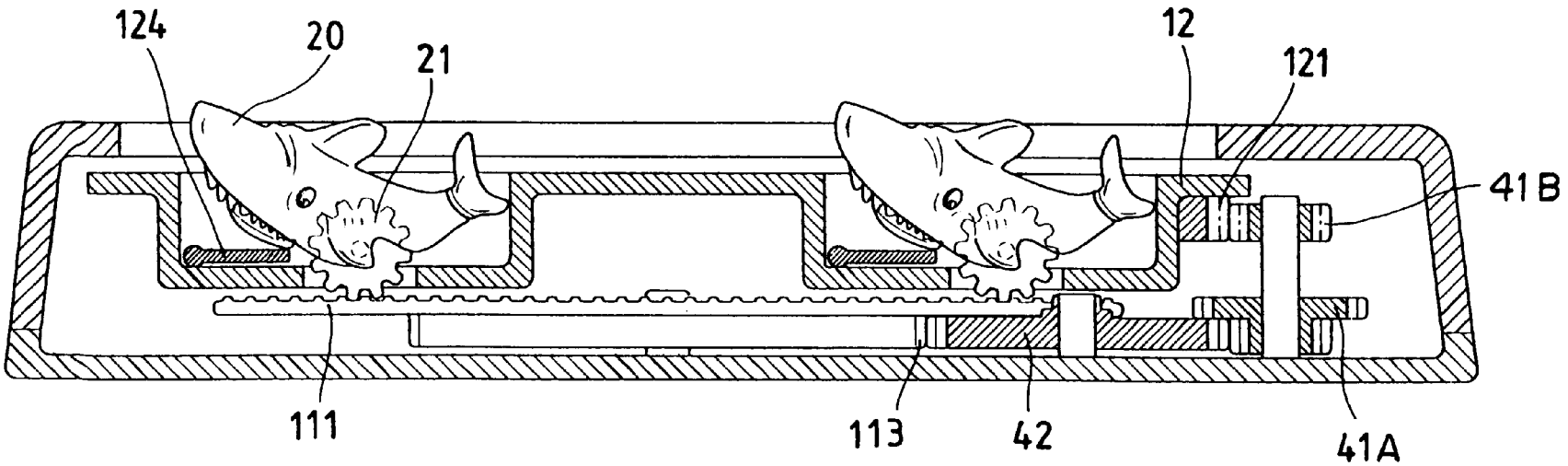
FIGS. 10 and 11 are longitudinal cross sectional views according to the present invention, showing the interaction of the toy fish body and the rotary disks.

In a practical application, the driving power mechanism is shown in FIG. 5 and FIG. 10. A motor drives a gear set 40 including a driving gear 41A engaging a transferring gear 42 and a driving gear 41B. The rack 121 on the rim of the loading disk 12 is directly engaged with the driving gear 41B to rotate the loading disk 12. Gear 41A engages transferring gear 42 to rotate the track disk 11. The toy fishes 20 horizontally arranged on the loading disk 12 are moved with the loading disk 12. The track disk 11 rotates inversely to the rotation of the loading disk 12. Rotation of the rack 111 on track disk 11 will also rotate the gears 21 in the toy fishes 20. The rotation of the gears 21 causes the blocks 211 (211') and 212 to push the fish tail block 221 (221') and the fish jaw block 231 (231').

Figure 11:
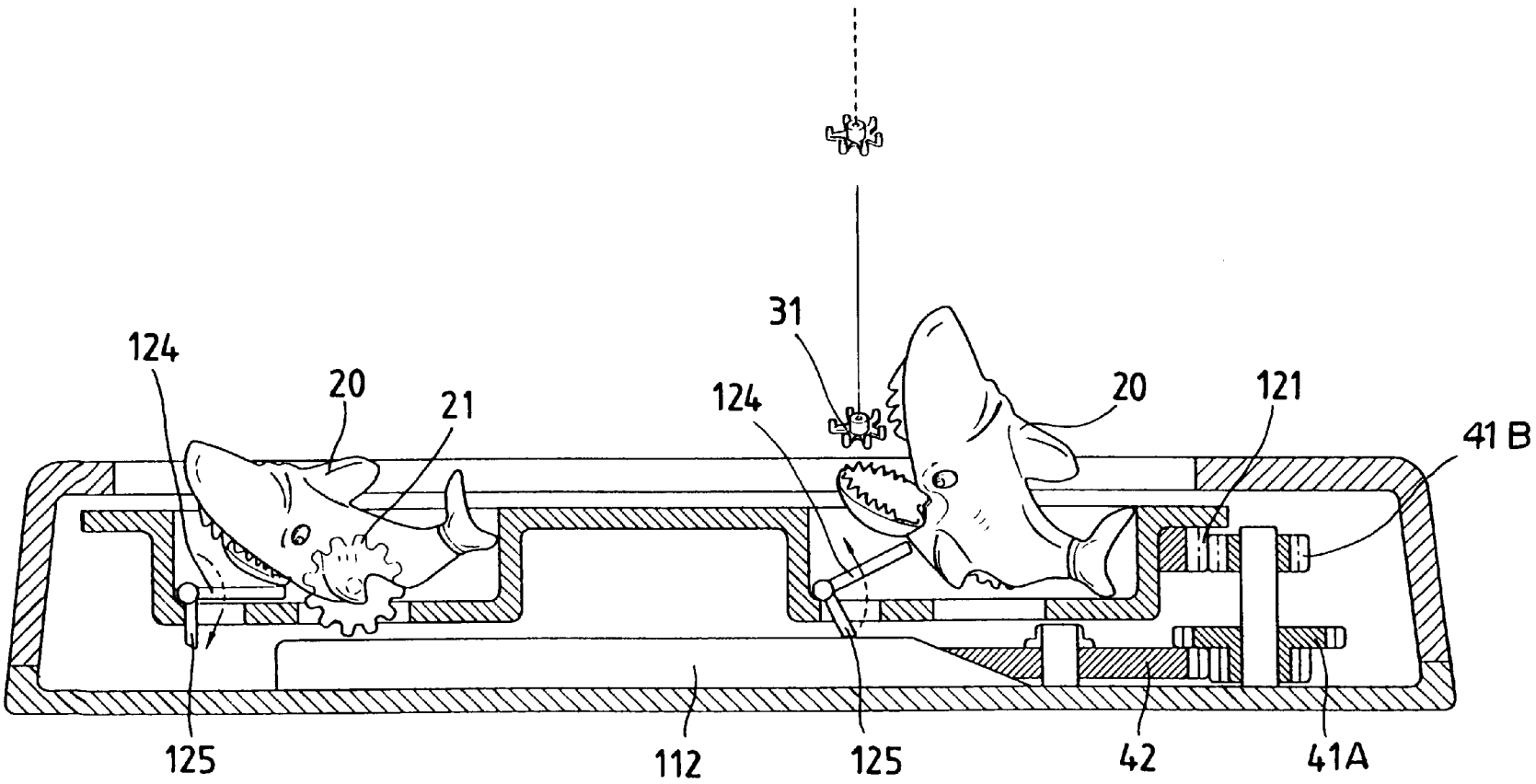

With reference to FIG. 11, when the short post 125 of the pivot member 124 contacts the cam plates 112 and 131, the pivot member 124 will move upwards so that the toy fish 20 moves upwards so that the gear 21 is separated from the rack 111, causing the fish jaw 23 to drop down and the mouth opens. The short post 125 will pass over the cam plate piece 112, then the pivot member 124 will drop down, restoring the toy fish 20 to the original state. Therefore, the user needs to match the action of the toy fish 20 to suspend a hook 31 from a fishing rod 30 in front of the mouth of the fish. When it moves upwards, the toy fish 20 will be hooked, thus the player will enjoy the fun of fishing.

Figure 12:
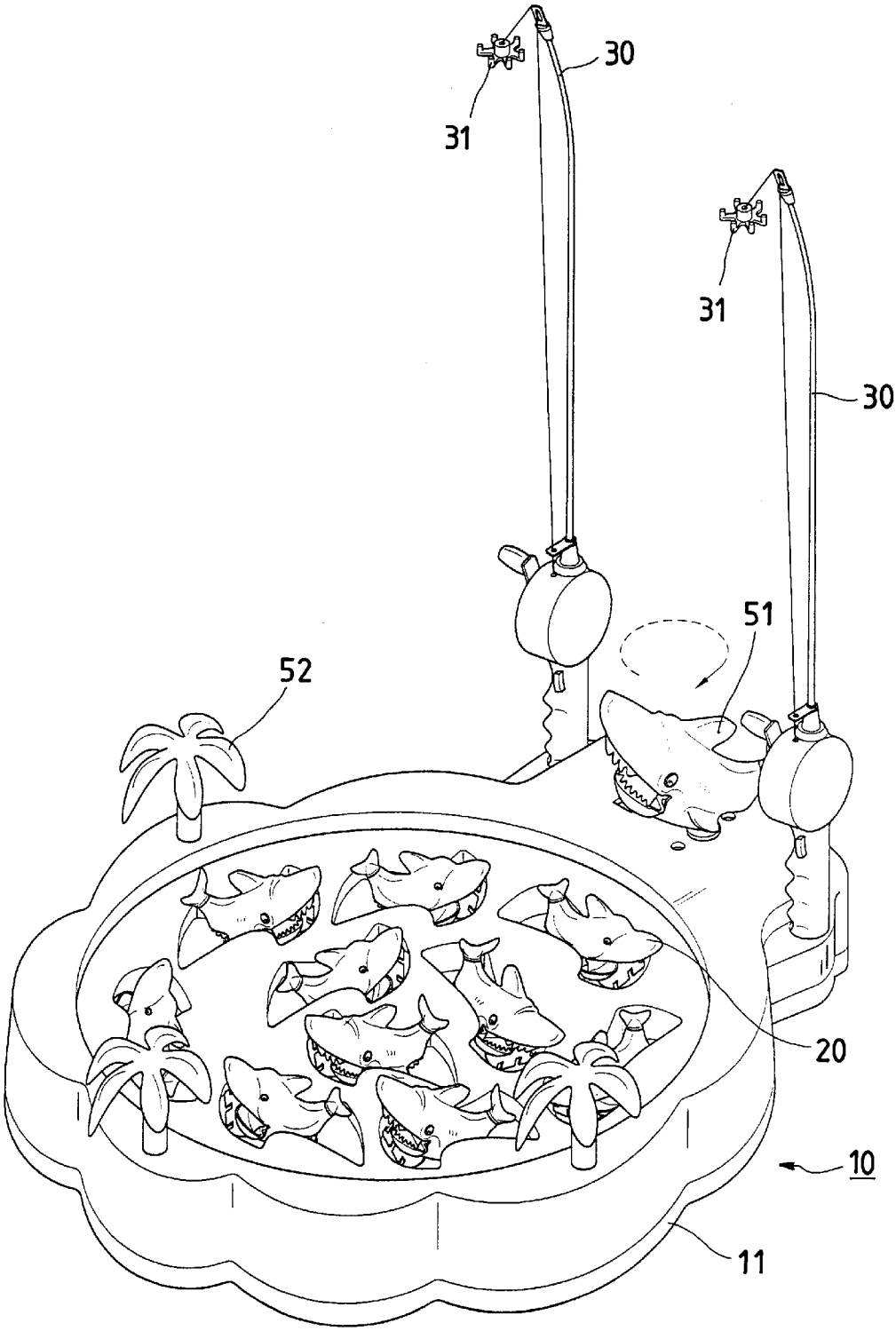
FIGS. 12 and 13 are perspective views showing an alternative embodiment of the fishing toy according to the present invention.
Figure 13:
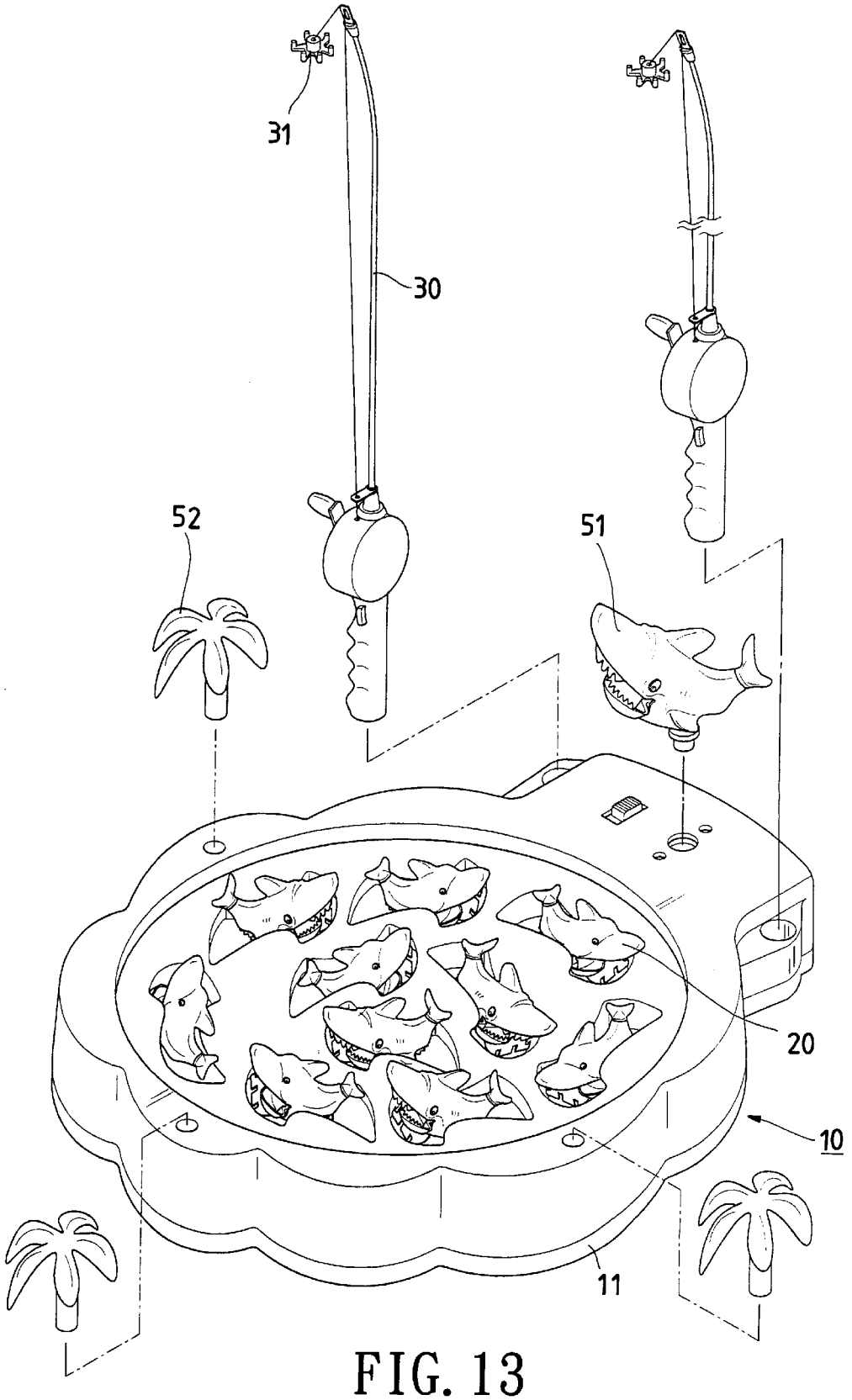
Figure 14:
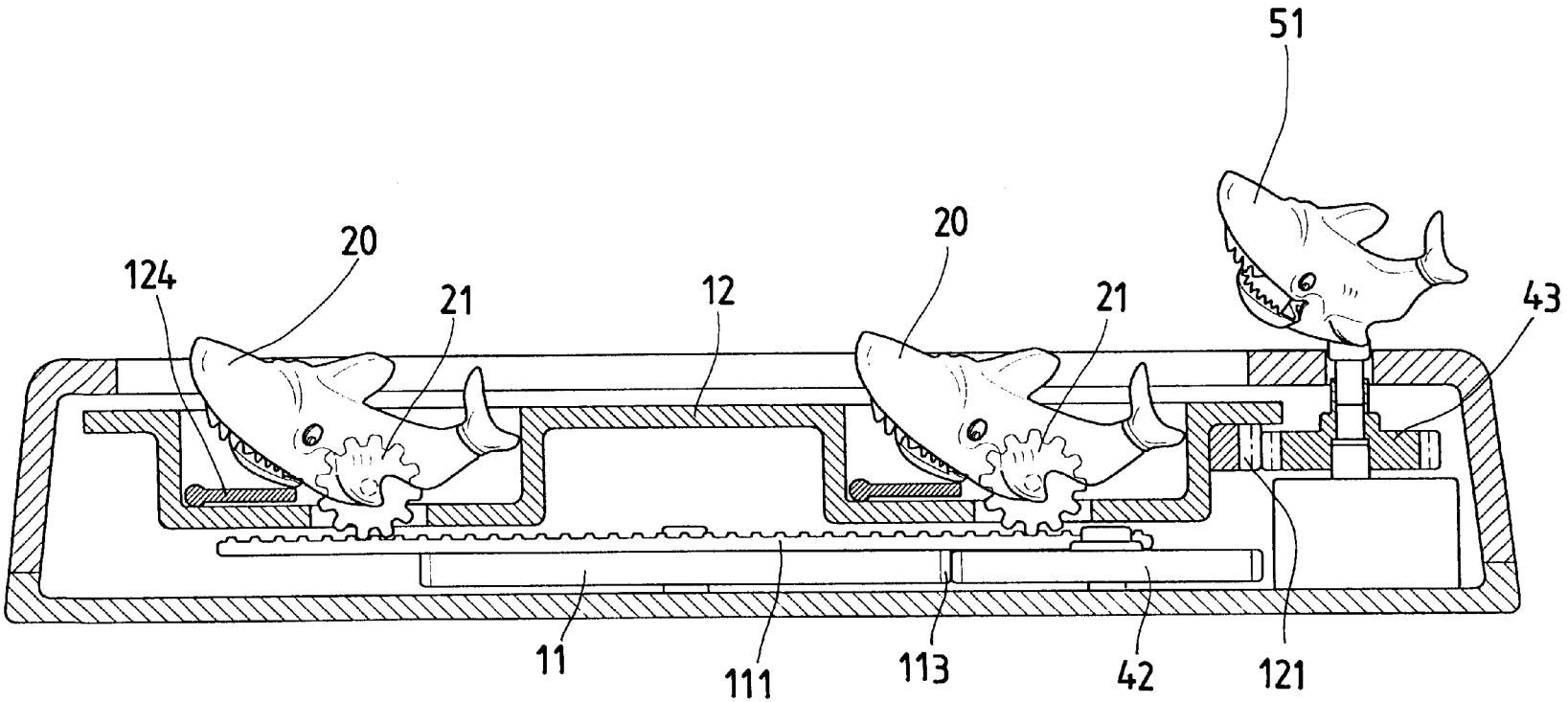
FIG. 14 is a cross-sectional view showing the embodiment of FIGS. 12 and 13.

Through a proper decoration, the beauty and interest may be increased. With reference to FIGS. 12–14, a fish shaped decoration 51 can be installed on a driven gear 43. The drive gear 43 is driven by the loading disk 12. When the loading disk 12 rotates, the fish shaped decoration 51 will rotate so that it may simulate the fishing field for increasing the interest of players.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A fishing toy comprising:

a) a base seat;

b) a track disk rotatably mounted on the base seat, the track disk having a first rack on a lower portion thereof, at least one second rack on an upper portion thereof and at least one first cam plate on the upper portion of the track disk;

c) a loading disk rotatably located on the base seat and disposed adjacent to and above the track disk, the loading disk having a plurality of receiving spaces in an upper surface, each receiving space having a hole through the loading disk;

d) a third rack adjacent to a periphery of the loading disk;

e) a plurality of toy fishes each removably located in one of the plurality of receiving spaces, each toy fish having a head portion with a movable jaw;

f) a plurality of pivot members pivotally attached to the loading disk, each pivot member located in one of the plurality of receiving spaces so as to contact the toy fish therein, each pivot member having a short post extending below the loading disk;

g) at least one second cam plate extending from the base seat;

h) a gear rotatably mounted in each toy fish and extending below the loading disk when the toy fish is in the receiving space; and, i) a drive mechanism for simultaneously rotating the track disk and loading disk in opposite directions whereby the gear in the toy fish engages the at least one second rack on the track disk, and the short arms of the pivoting members contact at least one of said first cam plate or second cam plate so as to pivot member, thereby moving the head portion of the associated toy fish upwardly, the drive mechanism including a first driving gear and a second driving gear, the first driving gear engaged with a transfer gear which also engages the first rack to rotate the track disk in a first direction, the second driving gear engaging the third rack to rotate the loading disk in a second, opposite direction.

2. The fishing toy of claim 1 wherein each toy fish further comprises a movable tail portion.

3. The fishing toy of claim 1 wherein the first and second driving gears are located on a common shaft.

4. The fishing toy of claim 1 further comprising:

a) a fish shaped decoration rotatably mounted on the base seat; and, b) a driven gear connected to the fish shaped decoration and engaging the third rack such that rotation of the loading disk rotates the fish shaped decoration.

* * * * *